US012673272B2

(12) United States Patent
Kamiyama

(10) Patent No.: US 12,673,272 B2
(45) Date of Patent: Jul. 7, 2026

(54) TRANSFORMABLE TOY AND BUILDING TOY

(71) Applicant: EPOCH COMPANY, LTD., Tokyo (JP)

(72) Inventor: Kei Kamiyama, Tokyo (JP)

(73) Assignee: EPOCH COMPANY, LTD., Tokyo (JP)

( * ) Notice: Subject to any disclaimer, the term of this patent is extended or adjusted under 35 U.S.C. 154(b) by 116 days.

(21) Appl. No.: 18/103,599

(22) Filed: Jan. 31, 2023

(65) Prior Publication Data

US 2023/0241523 A1 Aug. 3, 2023

(30) Foreign Application Priority Data

Feb. 1, 2022 (JP) ..... 2022-014359
Oct. 31, 2022 (JP) ..... 2022-174590

(51) Int. Cl.
*A63H 3/52* (2022.01)
*A63H 33/00* (2006.01)

(52) U.S. Cl.
CPC ..... *A63H 3/52* (2013.01); *A63H 33/003* (2013.01)

(58) Field of Classification Search
CPC ..... A63H 3/53; A63H 33/003
See application file for complete search history.

(56) References Cited

U.S. PATENT DOCUMENTS 1,428,405 A * 9/1922 Wegener ..... A63H 33/044 446/478
1,517,030 A * 11/1924 Gardner ..... A63H 33/044 446/110
1,551,666 A * 9/1925 Jensen ..... A63H 33/044 446/110

(Continued)

FOREIGN PATENT DOCUMENTS

CH 354706 A * 5/1961 ..... A63H 3/52
CN 107398083 A 11/2017

(Continued)

OTHER PUBLICATIONS

Kradokfer, Machine Translation of CH Pat. No. 354,706 A, uploaded Jan. 14, 2025, Espacenet, 2 pages.*

(Continued)

*Primary Examiner* — Michael D Dennis
*Assistant Examiner* — Matthew B Stanczak
(74) *Attorney, Agent, or Firm* — Faegre Drinker Biddle & Reath LLP

(57) ABSTRACT

A transformable toy includes: a floor portion and a ceiling portion which define a first room therebetween; and a roof unit. The roof unit includes at least one leg portion extendable to downwardly protrude from the roof unit and retractable inside the roof unit. The transformable toy is transformable between a first form and a second form, the first form in which the roof unit is disposed on the ceiling portion in a state in which the at least one leg portion is retracted inside the roof unit, the second form in which the roof unit (Continued)

is disposed on the ceiling portion in a state in which the at least one leg portion extends to protrude downward from the roof unit to define a second room between the ceiling portion and the roof unit, the second room having a height dimension smaller than that of the first room.

9 Claims, 12 Drawing Sheets

(56) References Cited

U.S. PATENT DOCUMENTS 2,020,196 A * 11/1935 Mallgraf ..... A63H 3/52 446/478
2,183,681 A * 12/1939 Krout ..... A63H 3/52 446/77
2,259,783 A * 10/1941 Sparling ..... E04B 1/3442 446/478
3,341,987 A * 9/1967 Ragnhill ..... E04B 1/3445 446/478
3,691,671 A * 9/1972 Kroll ..... A63H 3/52 220/8
3,736,695 A * 6/1973 Wannan ..... A63H 3/52 446/478
3,888,039 A * 6/1975 Snyder ..... A63H 33/16 446/478
3,906,659 A * 9/1975 Walmer ..... A63H 3/52 446/110
3,955,307 A * 5/1976 Payton ..... A63H 33/00 446/92
3,996,693 A * 12/1976 Walmer ..... A63H 3/52 446/105
4,018,001 A * 4/1977 Walmer ..... A63H 3/52 446/104
4,021,960 A * 5/1977 Walmer ..... A63H 33/044 446/104
4,067,137 A * 1/1978 Korthase ..... A63H 3/52 446/478
4,070,789 A * 1/1978 Levenson ..... A63H 3/52 229/101
4,306,371 A * 12/1981 Walmer ..... A63H 3/52 446/110
4,508,519 A * 4/1985 Becker ..... A63H 3/52 446/478
4,755,159 A * 7/1988 Templeton ..... A63H 33/00 446/478
4,883,443 A * 11/1989 Chase ..... A63H 3/52 446/478
4,964,249 A * 10/1990 Payne ..... A63H 33/008 446/478
5,055,083 A * 10/1991 Walker ..... A63H 3/52 446/478
5,423,709 A * 6/1995 Summers ..... A63H 3/52 446/478
5,819,479 A * 10/1998 Rodriguez-Ferre ..... A63H 33/008 446/478
5,971,833 A * 10/1999 Rasmussen ..... A63H 3/52 446/478
6,283,819 B1 * 9/2001 Polinger ..... A63H 3/52 446/478
6,572,436 B1 * 6/2003 So ..... A63H 17/44 446/478
6,607,421 B1 * 8/2003 Rossi ..... A63H 3/52 52/79.5
6,937,152 B2 * 8/2005 Small ..... A63H 33/26 340/568.1
7,753,753 B2 * 7/2010 Payne ..... A63H 33/42 446/478
8,251,224 B2 * 8/2012 Meger ..... B65D 81/368 206/769
9,138,655 B2 * 9/2015 Yeung ..... A63H 33/42
9,416,528 B2 * 8/2016 Schaffert ..... E04B 1/3445
9,572,423 B1 * 2/2017 Stuart ..... A47B 85/06
10,022,644 B1 7/2018 Wakim et al.
10,864,451 B2 * 12/2020 Gupta ..... B65D 43/02
2005/0044804 A1 3/2005 Bin et al.
2009/0075560 A1 * 3/2009 Smith ..... A63H 3/52 446/478
2012/0015582 A1 * 1/2012 van Tilburg ..... A63H 3/52 446/110
2012/0045965 A1 * 2/2012 Zhou ..... A63H 3/52 446/478
2015/0056888 A1 * 2/2015 Pfiester ..... A63H 3/52 446/476
2018/0117489 A1 * 5/2018 Williams ..... G09F 1/00
2020/0078695 A1 * 3/2020 Burleson ..... A63H 3/52
2023/0241523 A1 * 8/2023 Kamiyama ..... A63H 3/52 446/476
2024/0173635 A1 * 5/2024 Davis ..... A63H 3/52

FOREIGN PATENT DOCUMENTS

CN 206924437 U 1/2018
CN 207838305 U 9/2018
CN 207856330 U 9/2018
JP S49-061931 A 6/1974
JP 3151312 U 6/2009
JP 2012-065808 A 4/2012
JP 6491769 B1 3/2019

OTHER PUBLICATIONS

First Chinese Office Action issued Sep. 17, 2025, in Application No. 202310049064.
Japanese Office Action issued Mar. 10, 2026 in Application No. 2022-174590.

* cited by examiner

TRANSFORMABLE TOY AND BUILDING TOY

CROSS-REFERENCE TO RELATED APPLICATIONS

This application is based on and claims priority under 35 USC 119 from Japanese Patent Application No. 2022-014359 filed on Feb. 1, 2022 and Japanese Patent Application No. 2022-174590 filed on Oct. 31, 2022, the contents of which are incorporated herein by reference.

TECHNICAL FIELD

The present disclosure relates to a transformable toy and a building toy.

BACKGROUND ART

There have been transformable toys in which a part of a toy imitating a building is transformable. For example, JP6491769B1 discloses a form changeable toy including a figure house imitating a tree. In the form changeable toy, by moving up and down a height position of an upstairs portion, which is a portion corresponding to a crown, it is possible to form a two-story house when the upstairs portion is at a first height position, and it is possible to form a three-story house provided with a third floor of an attic room when the upstairs portion is at a second height position.

SUMMARY OF INVENTION

Incidentally, a small-scale attic room provided in an attic of a toy imitating a building reminds a child, who is a player, of a secret room, and arouses his playfulness. However, in the form changing toy of JP6491769B1, by moving the upstairs portion up and down, a floor of the upstairs portion becomes a floor of a second floor in the case of the two-story house, and the floor of the upstairs portion becomes a floor of the third floor in the case of the three-story house and a room on the second floor is now on the third floor, so that the form changing toy has no form change of providing an attic room in an attic. In the form changing toy of JP6491769B1, since sizes of the rooms on the second floor and the third floor are substantially equal in the case of the three-story house, the form changing toy has no form change of providing a small-scale attic room.

An object of the present disclosure is to provide a transformable toy and a building toy which is transformable into a form in which a small-scale attic room is newly provided in an attic with a simple configuration.

One aspect of the present disclosure provides a transformable toy including: a floor portion and a ceiling portion which define a first room therebetween; and a roof unit, wherein the roof unit includes at least one leg portion extendable to downwardly protrude from the roof unit and retractable inside the roof unit, and wherein the transformable toy is transformable between a first form and a second form, the first form in which the roof unit is disposed on the ceiling portion in a state in which the at least one leg portion is retracted inside the roof unit, the second form in which the roof unit is disposed on the ceiling portion in a state in which the at least one leg portion extends to protrude downward from the roof unit to define a second room between the ceiling portion and the roof unit, the second room having a height dimension smaller than that of the first room.

Another aspect of the present disclosure provides a building toy including the above transformable toy. Yet another aspect of the present disclosure provides a building toy including: a transformable toy; and a vehicle figure body, wherein the transformable toy includes: a floor portion and a ceiling portion which define a first room therebetween; and a roof unit, wherein the roof unit includes at least one leg portion extendable to downwardly protrude from the roof unit and retractable inside the roof unit, wherein the transformable toy is transformable between a first form and a second form, the first form in which the roof unit is disposed on the ceiling portion in a state in which the at least one leg portion is retracted inside the roof unit, the second form in which the roof unit is disposed on the ceiling portion in a state in which the at least one leg portion extends to protrude downward from the roof unit to define a second room between the ceiling portion and the roof unit, the second room having a height dimension smaller than that of the first room, wherein an opening portion is provided in the ceiling portion, wherein a step-shaped member is provided at a position overlapping the opening portion on a back side of the ceiling portion and has a first end and a second end, the first end being rotatably connected to the back side of the ceiling portion by a rotation shaft, the second end being disposed on the back side of the ceiling portion and configured to be engaged by an engagement mechanism, wherein the first end of the step-shaped member is rotated around the rotation shaft by its own weight and the second end is lowered toward the floor portion side by releasing engagement of the step-shaped member by the engagement mechanism, wherein the vehicle figure body includes: a wheel that is allowed to be placed on the step-shaped member; and a figurine holding portion configured to hold a figurine, wherein the vehicle figure body is configured to slide down on the step-shaped member when the wheel is placed on the stepped member in a state in which the engagement is released, and wherein the figurine holding portion includes: a seat surface on which a figurine is disposed; a first wall portion erected on a first side of the seat surface; a second wall portion erected on a second side of the seat surface and recessed in a direction opposite to the seat surface; and an arm portion provided on the first side of the seat surface and tiltable toward the seat surface side.

According to the present disclosure, it is possible to provide a transformable toy and a building toy which can be transformed into a form in which a small-scale attic room is newly provided in an attic with a simple configuration.

BRIEF DESCRIPTION OF DRAWINGS

The present disclosure will be described in detail based on the following figures, wherein:

FIG. 2A and FIG. 2B are perspective views showing states before and after transformation of the building toy according to the embodiment, in which FIG. 2A is a perspective view of a vicinity of a second-floor right room in a state in which a storage ladder is stored in a first form, and FIG. 2B is a perspective view of the vicinity of the second-floor right room in a state in which the storage ladder is lowered in a second form;

DESCRIPTION OF EMBODIMENTS

Figure 1:
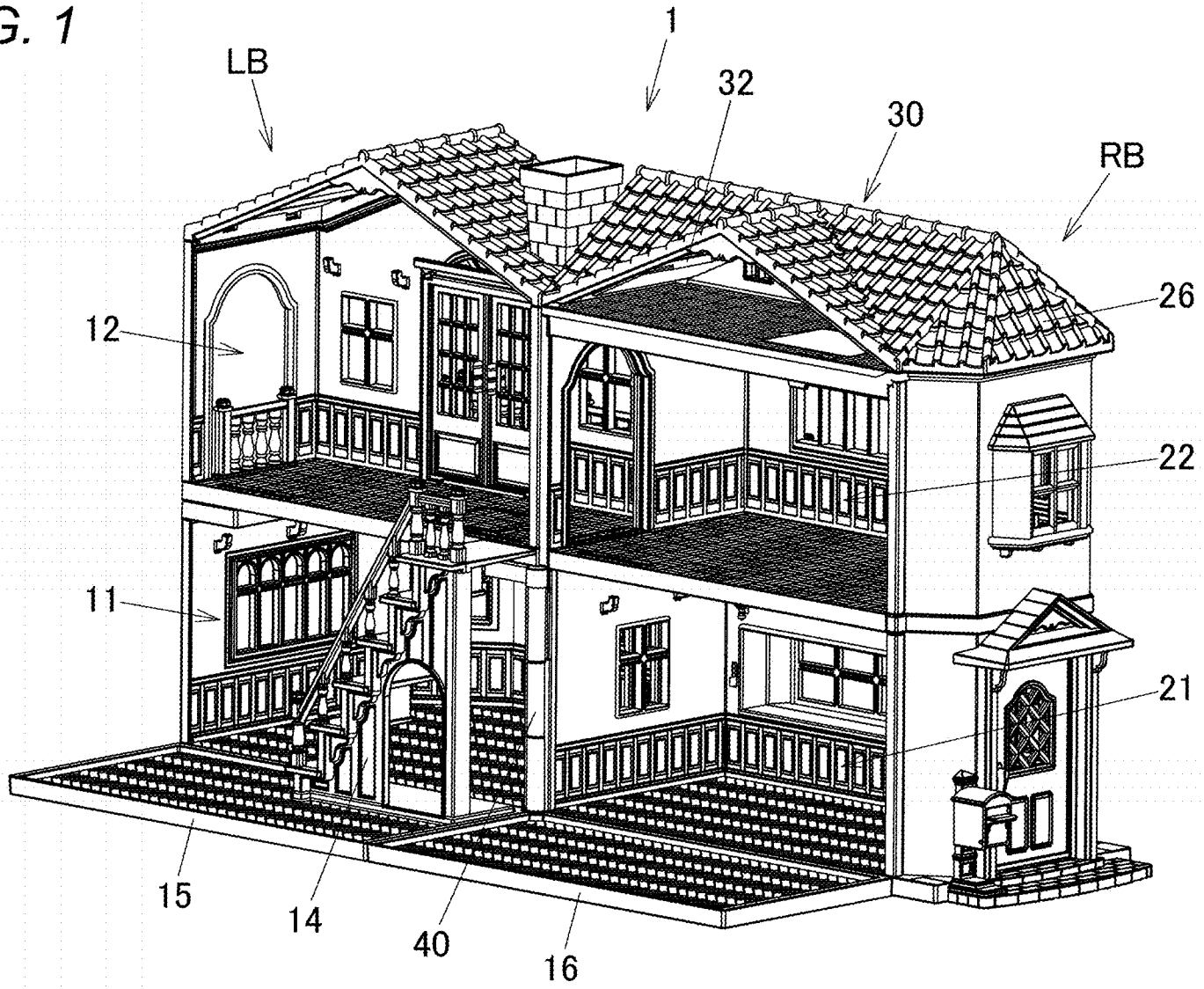
FIG. 1 is an overall perspective view of a building toy according to an embodiment.

An embodiment of the present disclosure will be described with reference to the drawings. A building toy 1 shown in FIG. 1 has two floors, and is divided into a left-side portion LB and a right-side portion RB. The building toy 1 includes a first-floor left room 11 and a second-floor left room 12 in the left-side portion LB, and includes a first-floor right room 21, a second-floor right room (first room) 22, and a roof unit 30 in the right-side portion RB. The left-side portion LB and the right-side portion RB of the building toy 1 are connected to each other via a hinge mechanism 40 provided between the first-floor left room 11 and the first-floor right room 21. FIG. 1 shows a state in which the building toy 1 is divided into the left-side portion LB and the right-side portion RB by the hinge mechanism 40 and opened to both sides, and the rooms 11, 12, 21, and 22 are opened to a front side. A player can play with figurines or the like by placing a toy imitating a figure body or furniture in the rooms 11, 12, 21, and 22.

In the present embodiment, the building toy 1 is described in a state in which the building toy 1 is opened to both sides as shown in FIG. 1. In the following description, an upper side in FIG. 1 is an upper side of the building toy 1, the opposite side is a lower side, a left side in FIG. 1 is a left side of the building toy 1, the opposite side is a right side, the front side in FIG. 1 is a front side of the building toy 1, and the opposite side is a rear side. As shown in FIG. 1, in a state in which the building toy 1 is opened to both sides, a player can place stairs 14, a left side expansion floor 15, and the like in front of the left-side portion LB, and place a right-side expansion floor 16 and the like in front of the right-side portion RB.

Figure 2A:
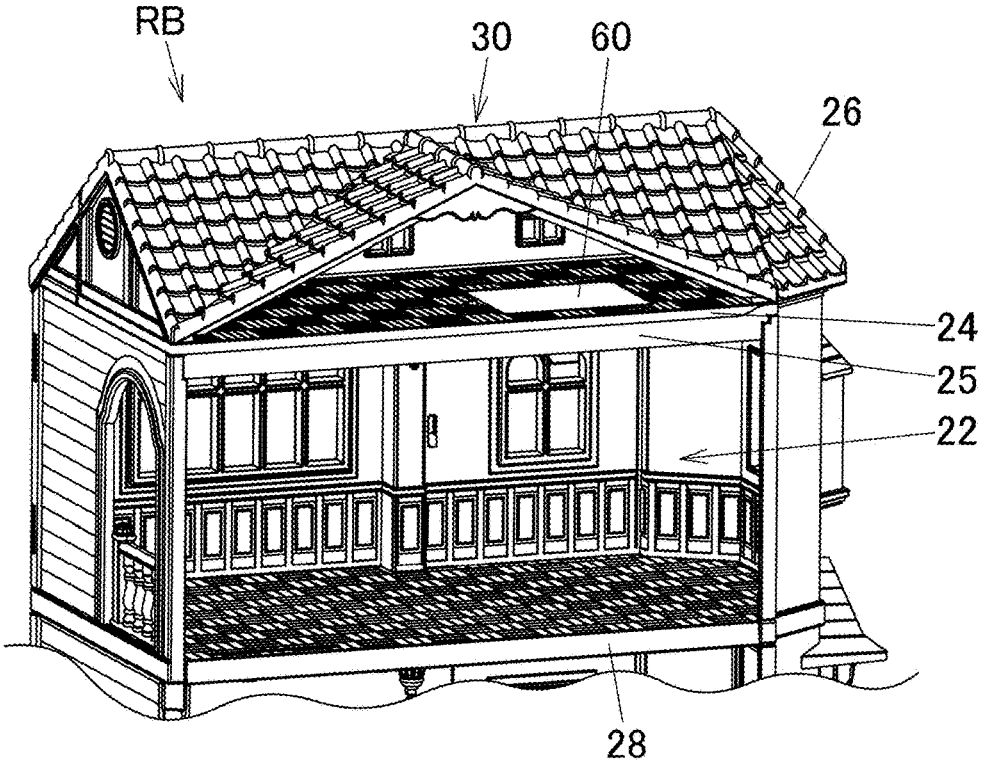

As shown in FIG. 2A, the roof unit 30 is disposed above a ceiling (hereinafter, referred to as a "ceiling portion 24") of the second-floor right room 22 as a roof of the right-side portion RB of the building toy 1. In the state shown in FIG. 2A, a roof portion 36 of the roof unit 30 is connected to a roof (hereinafter, referred to as a "second-floor right roof (outer roof portion) 26") provided on an upper side of a side wall portion of the second-floor right room 22.

Figure 2B:
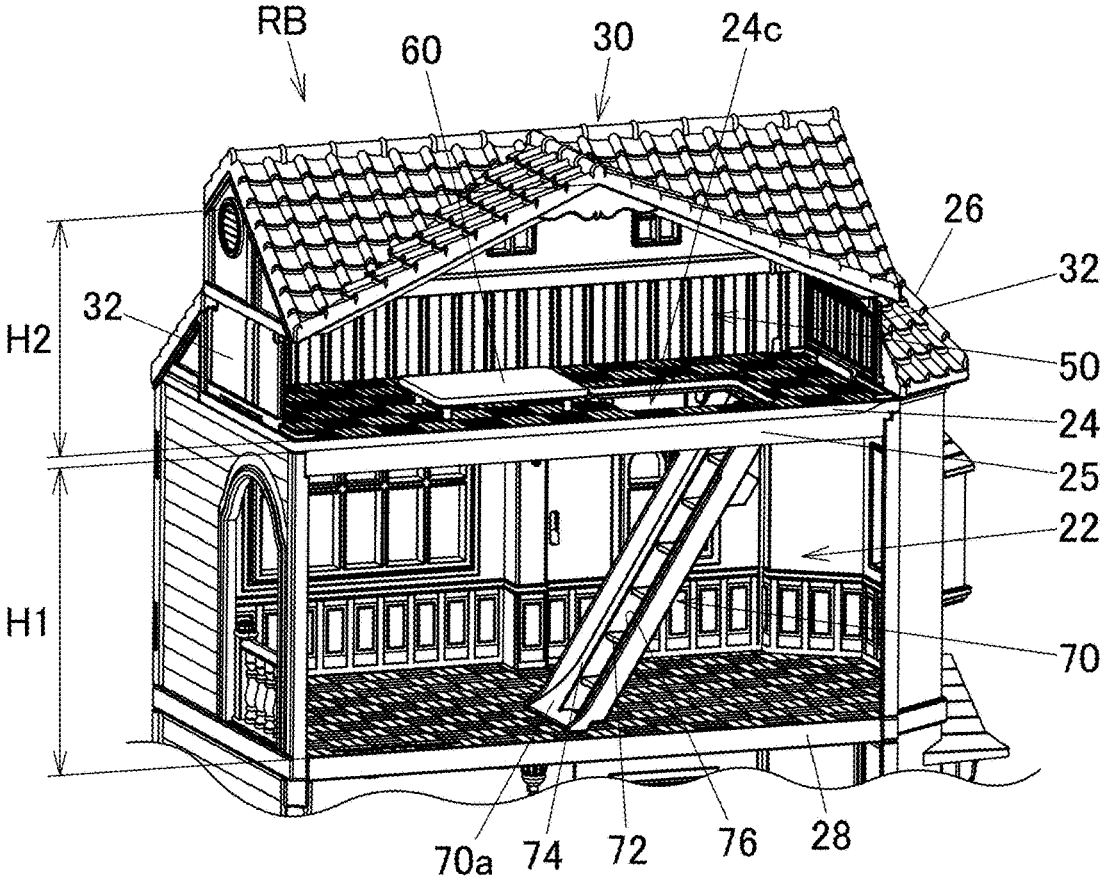

On the other hand, as shown in FIG. 2B, in the building toy 1, the roof unit 30 is disposed on an upper side of the ceiling portion 24 in a state in which leg portions 32 of the roof unit 30, which will be described later, extend to downwardly protrude, and thus, an attic room (second room) 50 having a height dimension H2 smaller than a height dimension H1 of the second-floor right room 22 can be newly provided on the upper side of the ceiling portion 24, in other words, between the ceiling portion 24 and the roof portion 36 of the roof unit 30. As described above, the building toy 1 can be transformed between a two-story form (hereinafter, referred to as a "first form") in which the roof unit 30 is disposed as a part of the roof of the right-side portion RB of the building toy 1 and a three-story form (hereinafter, referred to as a "second form") in which the attic room 50 is provided on the upper side of the ceiling portion 24.

In the building toy 1, a storage ladder (step-shaped member) 70 is stored on a lower surface 24*b* side (back side) of the ceiling portion 24 (see FIG. 10), and the storage ladder 70 can be changed from a state of being stored (see FIG. 2A) to a state of being lowered to a floor (hereinafter, referred to as a "floor portion 28") side of the second-floor right room 22 (see FIG. 2B). A storage mode of the storage ladder 70 will be described in detail later. A bent wall portion 25 that is bent at a substantially right angle from the ceiling portion 24 and slightly extends downward is provided at a front end of the ceiling portion 24, and in the state in which the storage ladder 70 is stored, the storage ladder 70 is hidden by the bent wall portion 25 and cannot be visually recognized from the front side.

Figure 3:
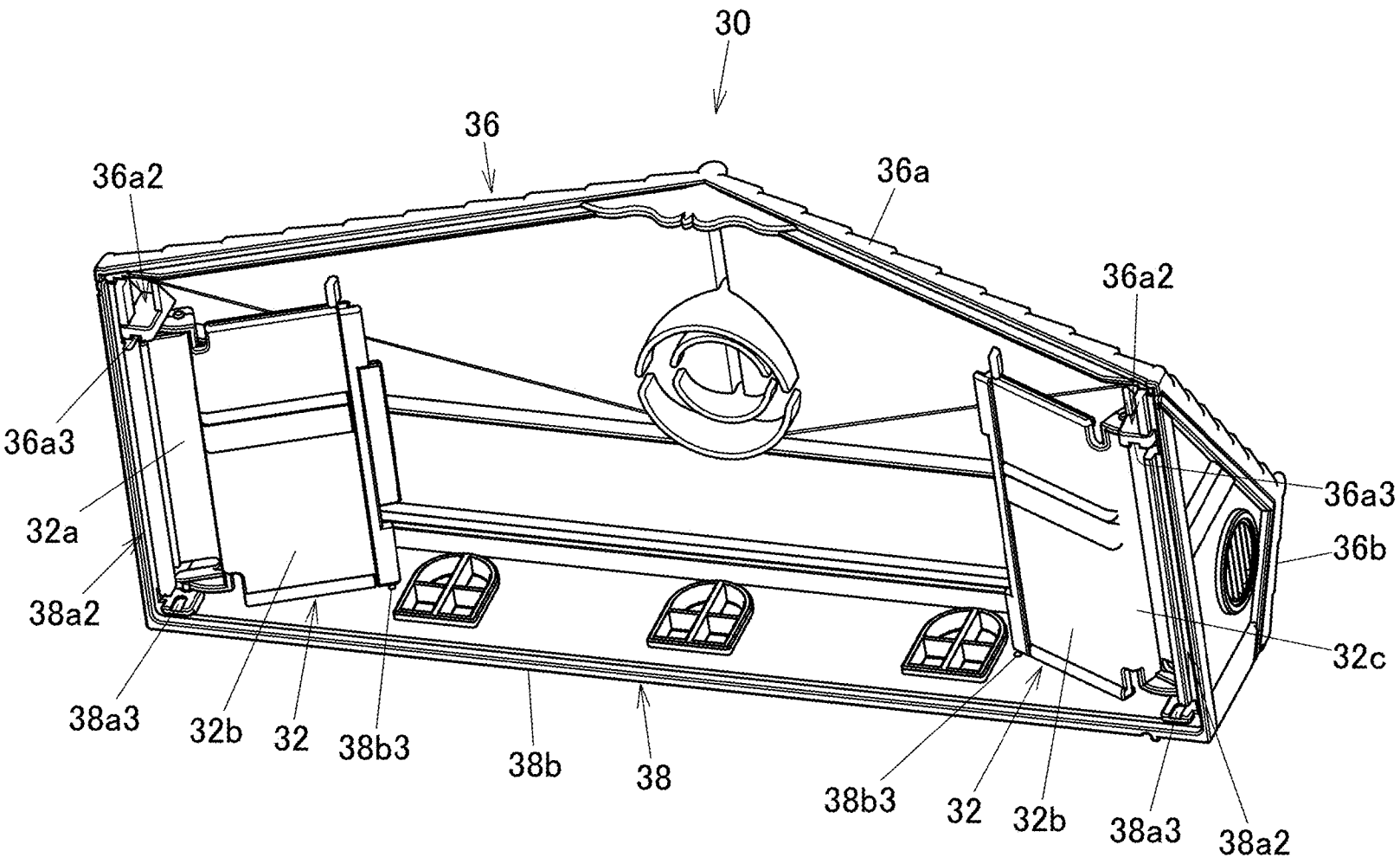
FIG. 3 is a perspective view of a roof unit.

Next, a configuration of the roof unit 30 will be described in detail. As shown in FIG. 3, the roof unit 30 includes the pair of leg portions 32, the roof portion 36, and a side wall portion 38, and is constructed by assembling these members. The pair of leg portions 32 are bilaterally symmetrical.

Figure 4:
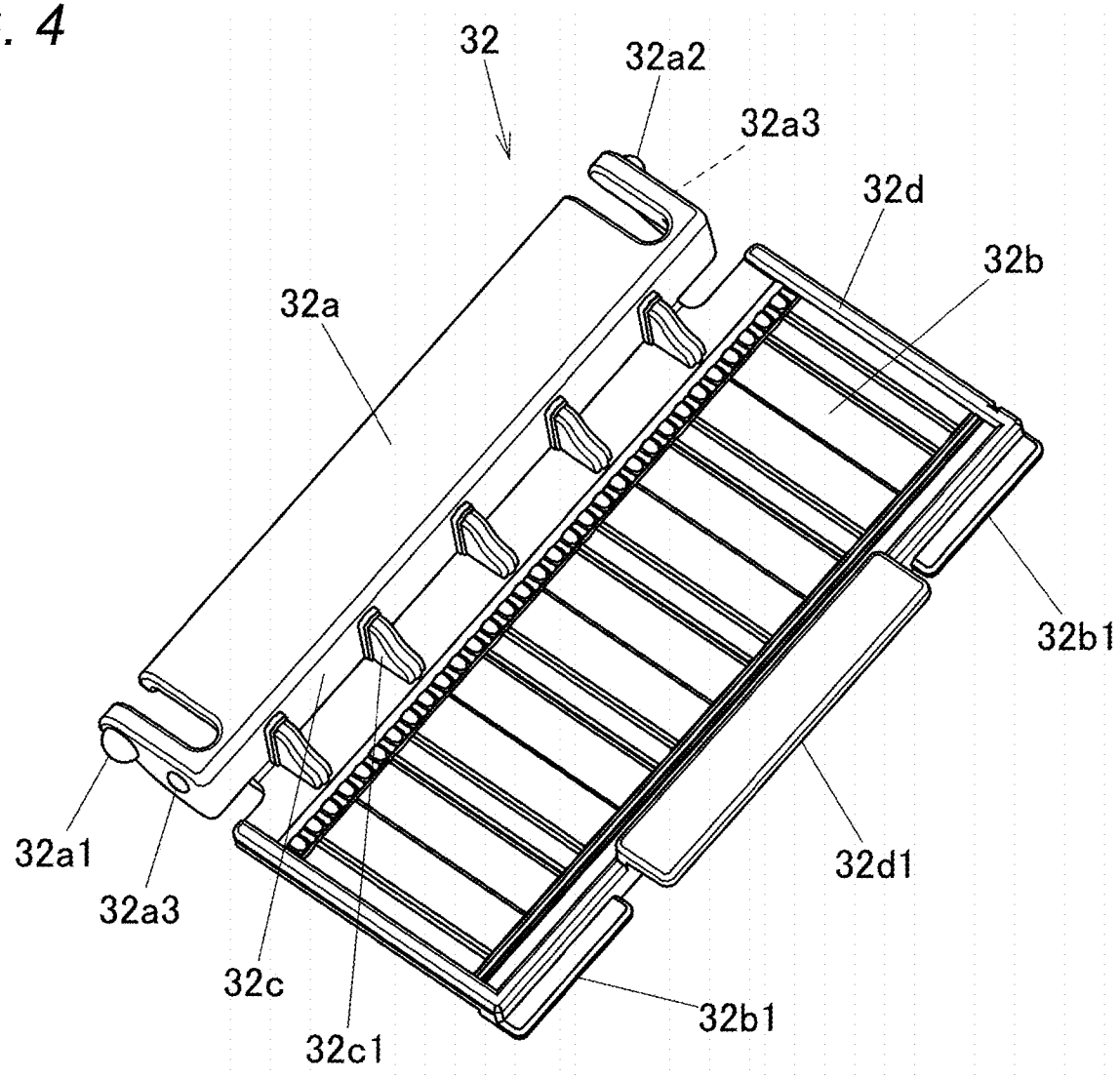
FIG. 4 is a perspective view of one leg portion.

As shown in FIG. 4, the leg portion 32 includes a base portion 32*a*, a plate-shaped portion 32*b* connected to the base portion 32*a* in a stepped manner, and a stepped portion 32*c* connecting the base portion 32*a* and the plate-shaped portion 32*b*. The leg portion 32 is a leaf spring whose entire body has elasticity. The base portion 32*a* has a longitudinally-elongated plate shape, and one end side of the base portion 32*a* in a shorter-side direction is connected to the stepped portion 32*c*. On the other end side in the shorter-side direction of the base portion 32*a*, a front rotating portion (rotating portion) 32*a*1 having a protruding shape is provided in a protruding manner on a front portion thereof, and a rear rotating portion (rotating portion) 32*a*2 having a protruding shape is provided in a protruding manner on a rear portion thereof. The front rotating portion 32*a*1 and the rear rotating portion 32*a*2 are provided coaxially, and a size of the front rotating portion 32*a*1 is slightly larger than that of the rear rotating portion 32*a*2. Leg portion-side protrusions 32*a*3 in a protruding shape are respectively provided in vicinities of the front rotating portion 32*a*1 and the rear rotating portion 32*a*2 in the base portion 32*a*.

The plate-shaped portion 32*b* has a longitudinally-elongated rectangular plate shape, and one end thereof in the shorter-side direction is connected to the stepped portion 32*c*. A raised portion 32*d* slightly raised from the plate-shaped portion 32*b* toward the base portion 32*a* is provided at portions of end edges of the plate-shaped portion 32*b* excluding a portion connected to the stepped portion 32*c*. The raised portion 32*d* functions as a rib for ensuring the strength of the leg portion 32. The stepped portion 32*c* is also provided with five reinforcing ribs 32*c*1 for ensuring the strength of the leg portion 32. An inner contact piece 32*d*1 extending toward the outside (the opposite side to the stepped portion 32*c* side) is provided on a part of the raised portion 32*d* existing at the end edge of the other end in the shorter-side direction of the plate-shaped portion 32*b*. The part of the raised portion 32*d* is positioned at a substantially central portion of the plate-shaped portion 32*b* in the longer-side direction. At the other end of the plate-shaped portion 32*b* in the shorter-side direction, a pair of outer contact pieces 32*b*1 are provided to extend outward from both sides in the longer-side direction.

Figure 5:
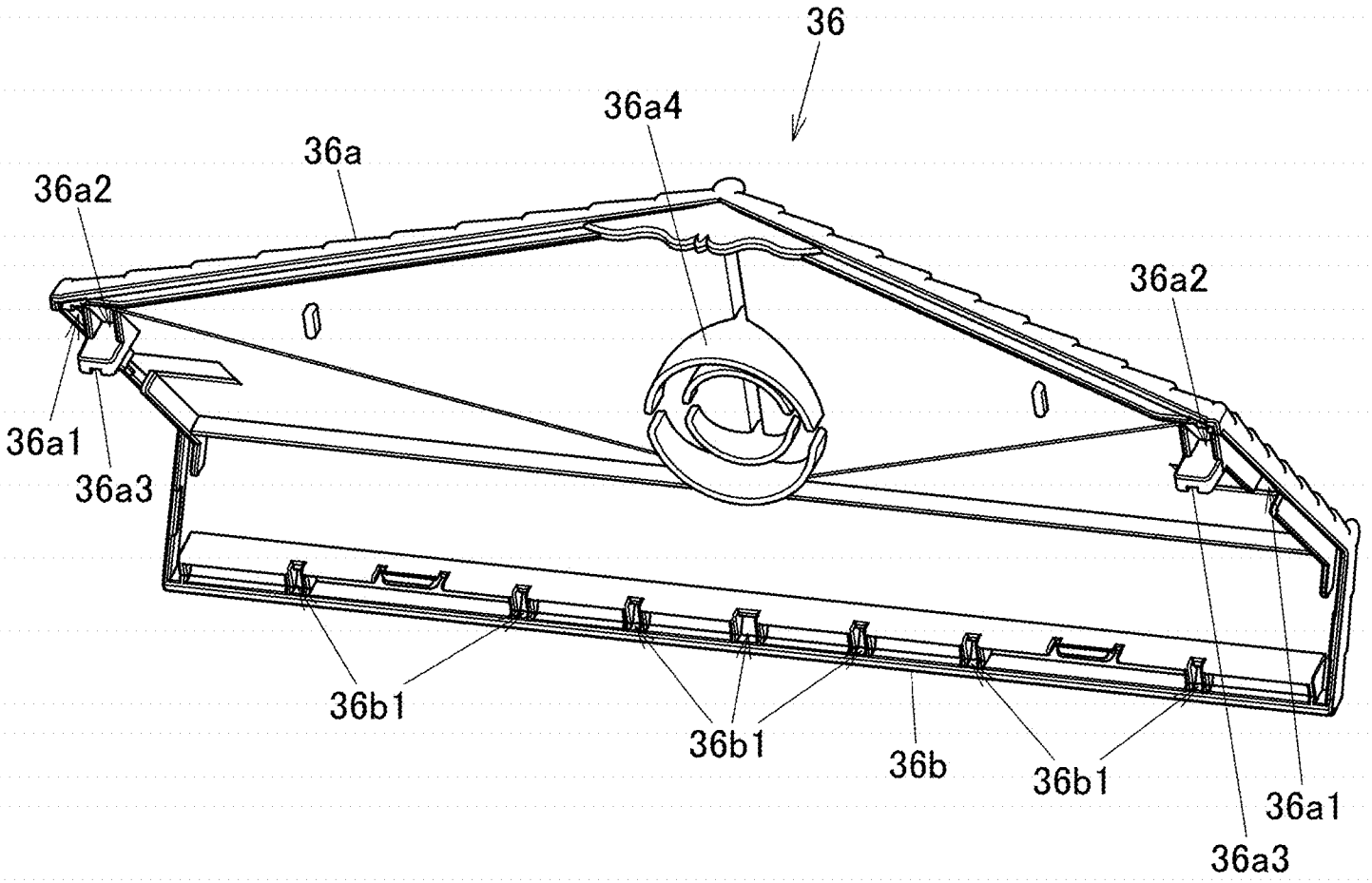
FIG. 5 is a perspective view of a roof portion.

As shown in FIG. 5, the roof portion 36 includes a first roof portion 36*a* that is inclined in a substantially V-shape when viewed from the front, and a second roof portion 36*b* that is inclined rearward and downward from a rear end of the first roof portion 36*a*. Fitting groove portions 36*a*1 that open downward and extend along the inclination of the first roof portion 36*a* are provided at left and right end edge portions of the first roof portion 36*a*, respectively. Front receiving portions 36*a*2 are respectively provided on front sides of left and right ends of the first roof portion 36*a*. A substantially recess (not shown) for receiving the front rotating portion 32*a*1 of the leg portion 32 is provided on a back surface side (a side facing the second roof portion 36*b*) of the front receiving portion 36*a*2. Further, a front holding groove portion 36*a*3 extending in an upper-lower direction and opening downward is provided on the back surface side of the front receiving portion 36*a*2.

A circular light attachment portion 36*a*4, which is bent in an arc shape and extends downward, is provided at a substantially central portion of an inner surface of the first roof portion 36*a*. For example, a member imitating a light is attached to the light attachment portion 36*a*4. Meanwhile, seven positioning recess portions 36*b*1 having a recessed shape are provided at a rear end edge portion of the second roof portion 36*b* at intervals in a left-right direction.

Figure 6:
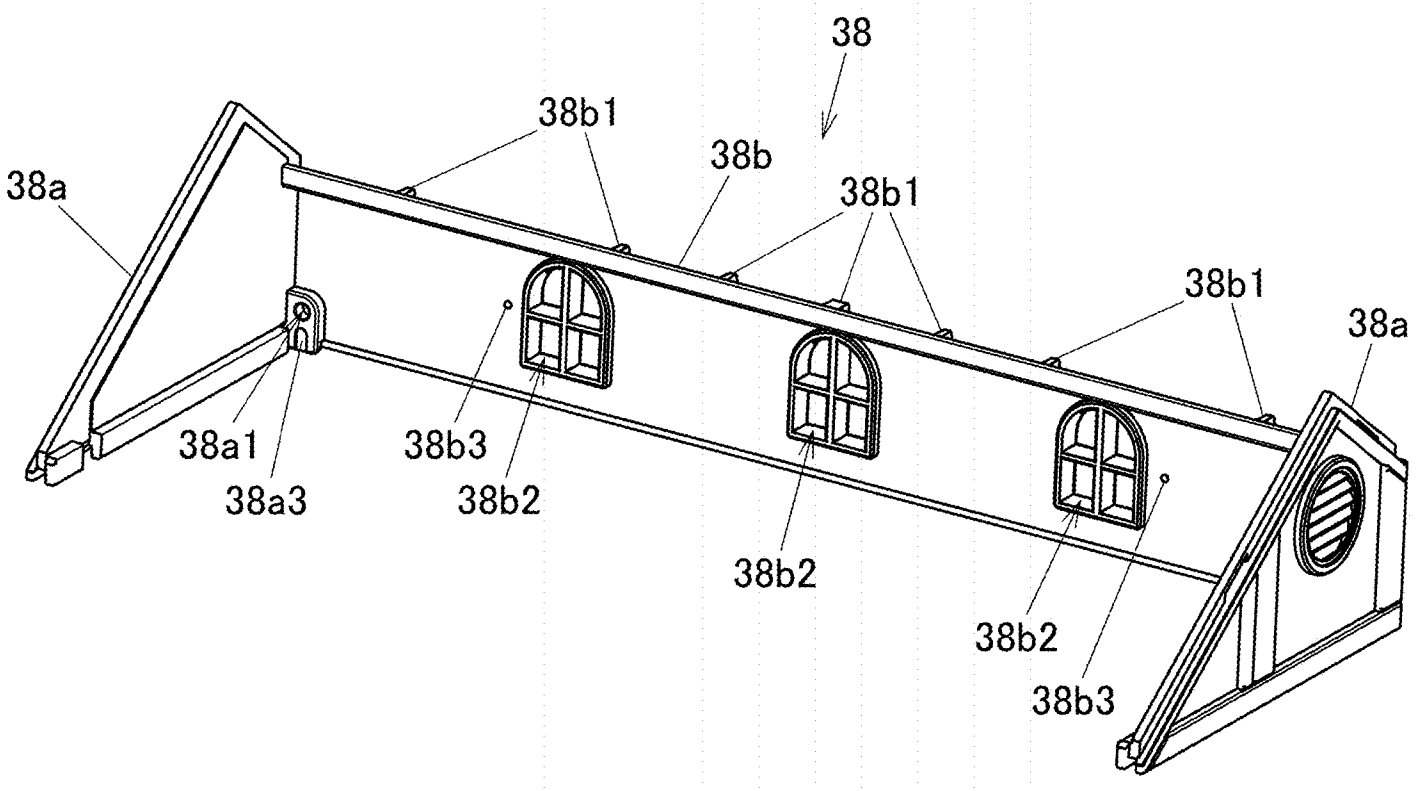
FIG. 6 is a perspective view of a side wall portion.

As shown in FIG. 6, the side wall portion 38 includes a pair of left and right wall portions 38*a* whose upper ends are inclined along the inclination of both side ends of the roof portion 36, and a rear wall portion 38*b* connecting the left and right wall portions 38*a*. The left and right wall portions 38*a* are flat plate-shaped members having both plate surfaces oriented in a left-right direction, and face each other so as to be parallel to each other. A rear receiving portion 38*a*1, which is recessed rearward in a substantially recessed shape and receives the front rotating portion 32*a*1 of the leg portion 32, is provided at a rear end lower portion of each of the left and right wall portions 38*a*. An arrangement groove portion 38*a*2 that opens downward and extends along a front-rear direction is provided at a lower end of each of the left and right wall portions 38*a* (see FIG. 3). Further, a rear holding groove portion 38*a*3 extending in the upper-lower direction and opening downward is provided on a lower side of the rear receiving portion 38*a*1.

The rear wall portion 38*b* of the side wall portion 38 is a laterally-elongated rectangular plate-shaped member having both plate surfaces oriented in the front-rear direction. On a rear surface of the rear wall portion 38*b*, seven positioning protrusion portions 38*b*1 protruding rearward are provided at intervals in the left-right direction. The rear wall portion 38*b* is provided with three opening groups 38*b*2 each imitating a window at equal intervals. A rear wall-side protrusion (holding portion) 38*b*3 in a protruding shape is provided in a vicinity of each of the opening groups 38*b*2 on both the left and right sides. The side wall portions 38 constitute left, right, and rear walls of the attic room 50 in the second form.

Referring back to FIG. 3, an assembling mode of the members constituting the roof unit 30 will be described. The positioning protrusion portions 38*b*1 of the side wall portion 38 are fitted into the positioning recess portions 36*b*1 of the roof portion 36, and upper ends of the left and right wall portions 38*a* of the side wall portion 38 are fitted into the fitting groove portions 36*a*1 of the roof portion 36. Thus, the roof portion 36 and the side wall portion 38 are assembled together in a state in which the roof portion 36 and the side wall portion 38 are positioned.

In an elastically deformed state, the rear rotating portions 32*a*2 of the leg portions 32 are rotatably fitted into the rear receiving portions 38*a*1 of the side wall portion 38, and the front rotating portions 32*a*1 are rotatably fitted into recesses provided in the front receiving portions 36*a*2 of the roof portion 36. Then, the leg portions 32 are attached to the side wall portion 38 and the roof portion 36 by being elastically restored. The leg portions 32 that are rotatably assembled are prevented from idling due to an elastic force thereof.

In the roof unit 30 assembled as described above, the leg portion 32 can be rotated around an axis (a rotation axis) connecting the front rotating portion 32*a*1 and the rear rotating portion 32*a*2, and the leg portion 32 can be rotated to be taken in and out of the roof portion 36. Then, by rotating the leg portion 32 until the plate-shaped portion 32*b* of the leg portion 32 climbs over the rear wall-side protrusion 38*b*3, the leg portion 32 is retracted inside the roof portion 36 so as to extend obliquely upward from the rotation axis toward a center of the roof portion 36 (see FIGS. 1 and 3), that is, in the first form. As a result, the leg portion 32 is held by the rear wall-side protrusion 38*b*3 such that the leg portion 32 extend obliquely upward from the rotation axis toward the center of the roof portion 36, and cannot be visually recognized when the roof unit 30 is viewed from the front side.

Then, by rotating the leg portion 32 from the first form by 90 degrees or more, the leg portion 32 can be transformed into the second form in which the leg portion 32 extends to downwardly protrude so as to be orthogonal to an upper surface 24*a* (see FIG. 7) of the ceiling portion 24 (see FIG. 2B). In the second form, the leg portion-side protrusion 32*a*3 provided on the front side of the leg portion 32 is fitted into the front holding groove portion 36*a*3 provided on the roof portion 36, and the leg portion-side protrusion 32*a*3 provided on the rear side of the leg portion 32 is fitted into the rear holding groove portion 38*a*3 provided on the side wall portion 38. As a result, the leg portion 32 is held in a state of extending to downwardly protrude. In the second form, the stepped portions 32*c* of the leg portions 32 are in contact with the lower ends of the left and right wall portions 38*a* of the side wall portion 38. As a result, the leg portions 32 are restricted from rotating further outward.

Figure 7:
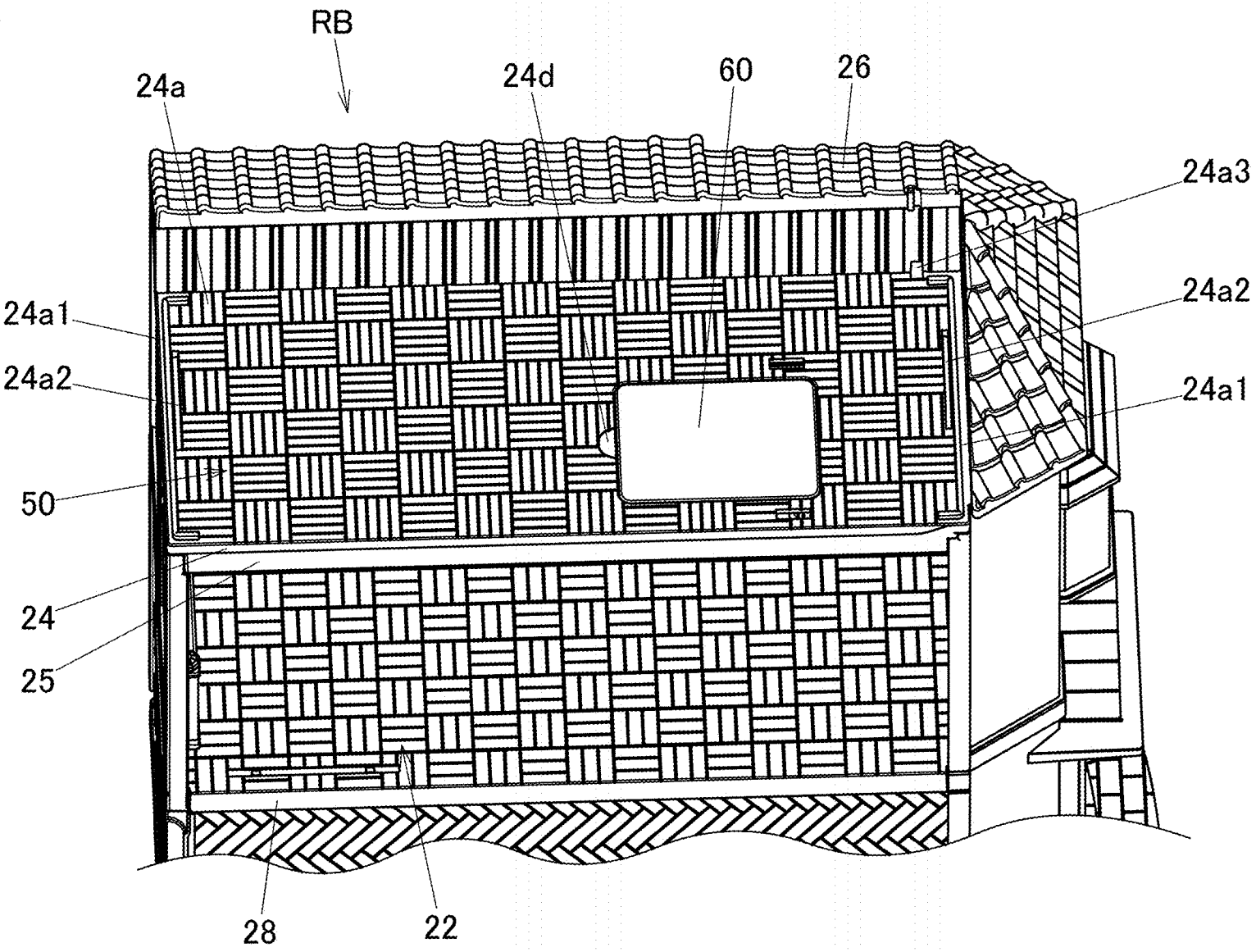
FIG. 7 is a perspective view of a ceiling portion as viewed from above.

Next, an arrangement mode of the roof unit 30 with respect to the ceiling portion 24 will be described. As shown in FIG. 7, the ceiling portion 24 has a longitudinal shape, and contact protrusion portions 24*a*1 (an example of a fitting portion) that protrude upward and are provided so as to have a substantially U shape in a top view are respectively provided on both sides (both left and right sides) in a longitudinal direction of the upper surface 24*a* of the ceiling portion 24. Further, an arrangement recess portion 24*a*2 which is slightly recessed adjacent to the contact protrusion portion 24*a*1 is provided at a substantially central portion in a front-rear direction on an inner side of each of the contact protrusion portions 24*a*1.

In the first form, the roof unit 30 is in a state in which the leg portion 32 is retracted inside and the arrangement groove portion 38*a*2 of the side wall portion 38 is exposed downward. In this form, in the roof unit 30, the arrangement groove portion 38*a*2 is fitted into the contact protrusion portion 24*a*1. As a result, the roof unit 30 is fixed on the ceiling portion 24 in a state in which the side wall portion 38 of the roof unit 30 is positioned in the left-right direction and the front-rear direction.

In the second form, the roof unit 30 is in a state in which the leg portion 32 extends to downwardly protrude. In this state, in the roof unit 30, the inner contact piece 32*d*1 of the leg portion 32 is fitted into the arrangement recess portion 24*a*2 and is in contact with the inner side of the contact protrusion portion 24*a*1, and the pair of outer contact pieces 32*b*1 of the leg portion 32 are in contact with outer sides of the contact protrusion portion 24*a*1. As a result, the contact protrusion portion 24*a*1 is sandwiched between the inner contact piece 32*d*1 and the pair of outer contact pieces 32*b*1, and the roof unit 30 is fixed on the ceiling portion 24 in a state in which the leg portion 32 of the roof unit 30 is positioned in the left-right direction and the front-rear direction.

An attic opening portion 24*c* that is open so as to penetrate through the ceiling portion 24 is provided at a position on a right front side of a central portion of the ceiling portion 24 (see FIG. 2B). The attic opening portion 24*c* is closed by fitting a cover member 60 having substantially the same shape and substantially the same size as an opening of the attic opening portion 24*c* (see FIG. 7). As shown in FIG. 2B, the cover member 60 has four protrusions serving as table legs on a back surface side thereof, and has a shape that imitates a table. A player can place the cover member 60 removed from the attic opening portion 24*c* on the upper surface 24*a* of the ceiling portion 24 or the like, and can play with figurines or the like using the cover member 60 as a table. A part of an opening end of the attic opening portion 24*c* is provided with a removal recess portion 24*d* that is recessed downward. The player can easily remove the cover member 60 from the attic opening portion 24*c* by inserting a finger or the like into the removal recess portion 24*d*.

Figure 8:
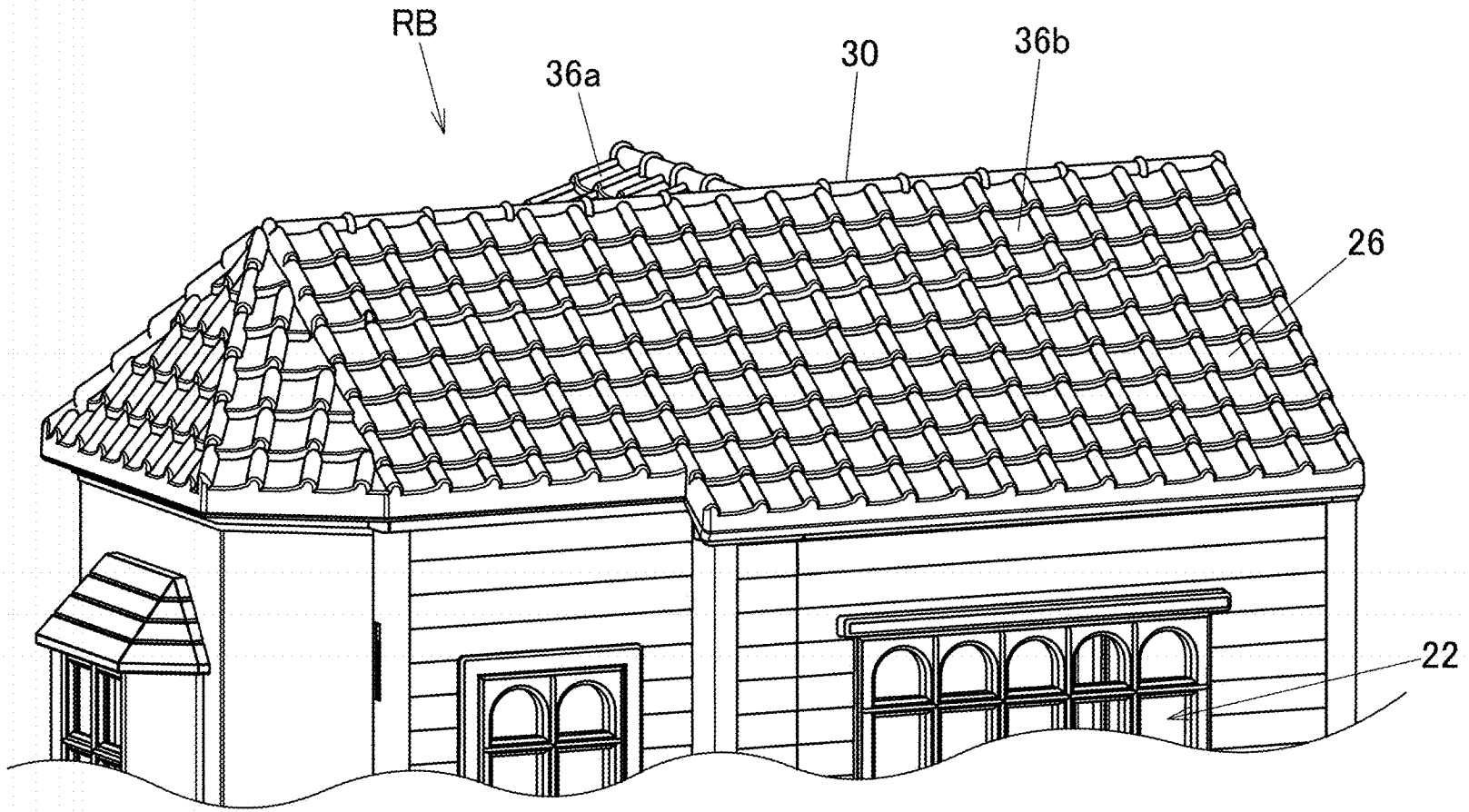
FIG. 8 is a perspective view of the roof portion and a second-floor right roof in the first form as viewed from the rear.

Next, a locking mode between the roof unit 30 and the second-floor right roof 26 will be described. As shown in FIG. 8, in the first form, the roof portion 36 of the roof unit 30 and the second-floor right roof 26 are connected to each other in such a manner that a boundary portion is hardly recognized.

Figure 9:
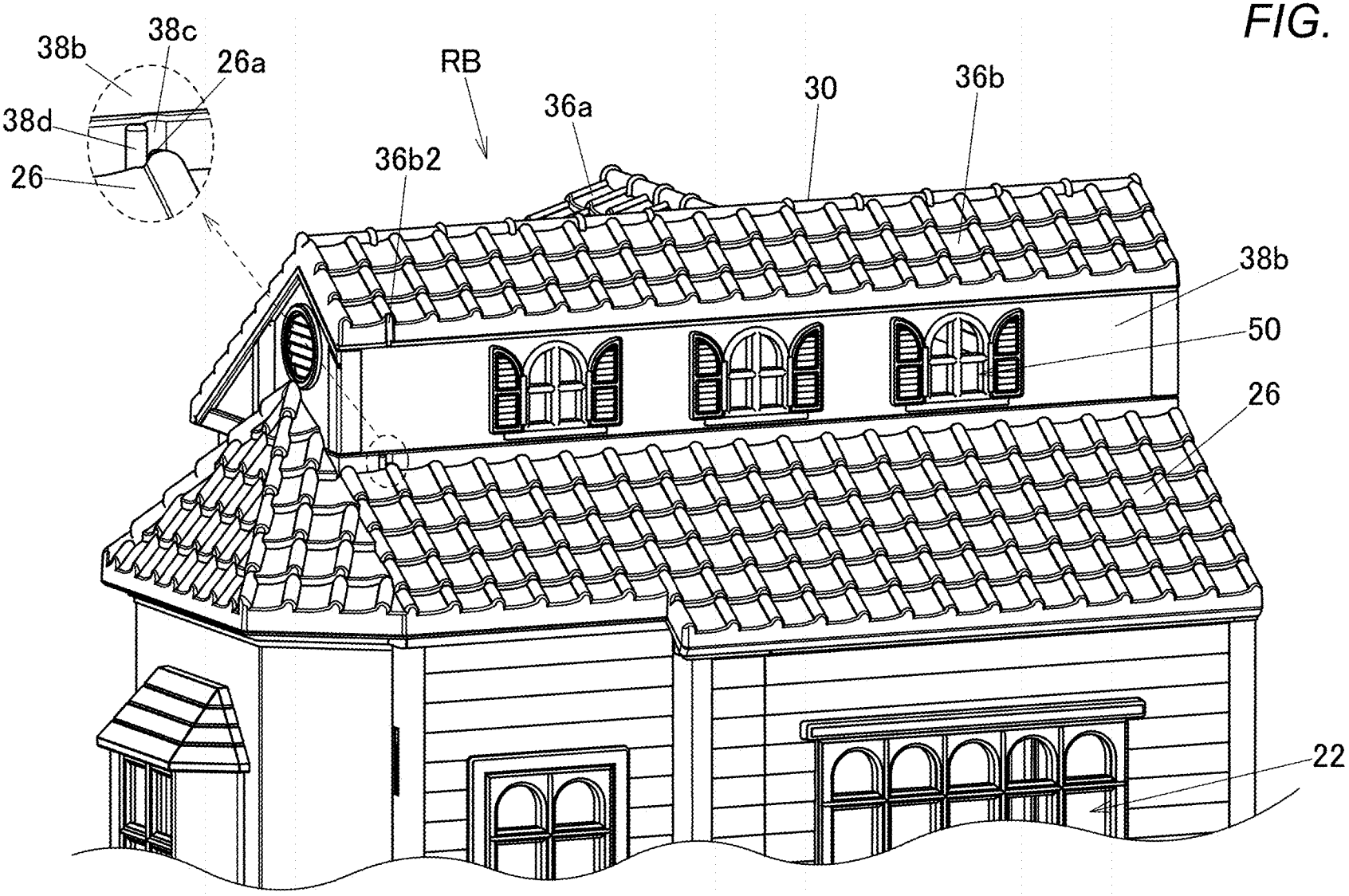
FIG. 9 is a perspective view of the roof portion and the second-floor right roof in the second form as viewed from the rear.

As shown in FIG. 9, in the second form, the side wall portion 38 of the roof unit 30 is exposed rearward. Here, a part of a tile portion provided at an upper end of the second-floor right roof 26 is provided with a locking portion 26*a* formed by extending one end of a round tile portion of a roof (see an enlarged view of a separate window shown in FIG. 9). On the other hand, a portion of the side wall portion 38 of the roof unit 30 facing the locking portion 26*a* in a front-rear direction in the second form is provided with a recessed groove 38*c* which is recessed in a substantially semicircular columnar groove shape and into which the locking portion 26*a* is fitted.

Further, a portion of the side wall portion 38 of the roof unit 30 which faces the locking portion 26*a* in a left-right direction in the second form is provided with a locked portion 38*d* which has a shape protruding from the side wall portion 38 in a substantially semicircular column shape and is locked to the locking portion 26*a*. Since the locking portion 26*a* and the locked portion 38*d* are in contact with each other in the left-right direction, the roof unit 30 is positioned in the left-right direction with respect to the second-floor right roof 26 in the second form, and the roof unit 30 is prevented from wobbling in the left-right direction in a state in which the leg portion 32 extends to downwardly protrude.

In a portion of the roof portion 36 overlapping with the locking portion 26*a* when the second-floor right roof 26 overlaps with the roof portion 36 in the first form, a roof-side recessed portion 36*b*2 for preventing the locking portion 26*a* from interfering with the portion is provided. In a portion of a wall surface around the ceiling portion 24 overlapping with the locked portion 38*d* when the side wall portion 38 overlaps with the wall surface in the first form, a wall-side recessed portion 24*a*3 (see FIG. 7) for preventing the locked portion 38*d* from interfering with the portion of the wall surface is provided.

Figure 10:
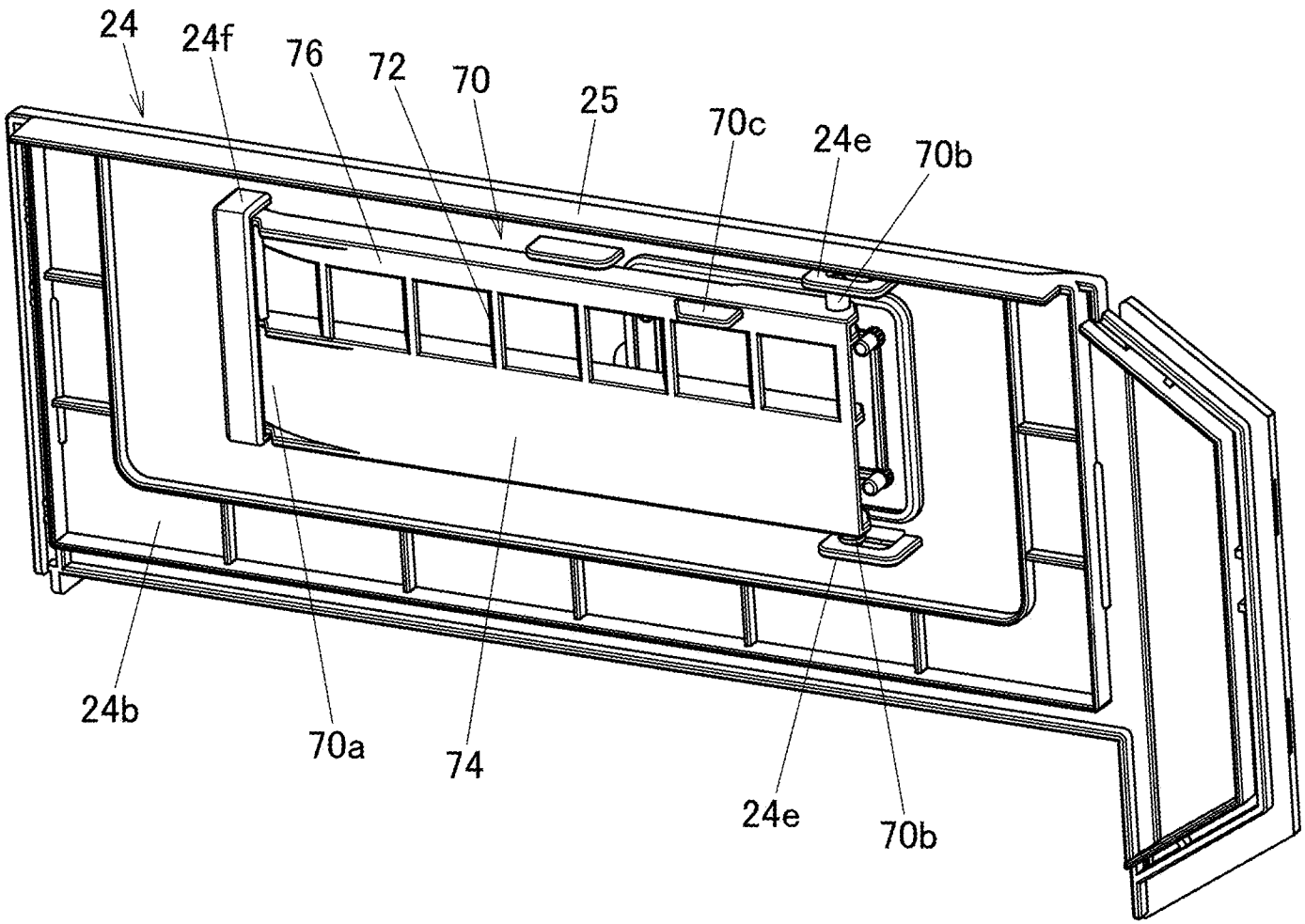
FIG. 10 is a perspective view of the ceiling portion in a state in which the storage ladder is stored, as viewed from below.

Next, a configuration of the storage ladder 70 stored on the lower surface 24*b* side of the ceiling portion 24 and a storage mode thereof will be described. As shown in FIGS. 2B and 10, the storage ladder 70 has a longitudinally-elongated shape as a whole, and substantially half portion on one side thereof is a ladder portion 72 having a ladder shape, and substantially half portion on the other side thereof is an inclined surface portion 74 having an inclined surface shape. A groove portion 76 formed in a groove shape along a longitudinal direction of the storage ladder 70 is provided on the opposite side of the inclined surface portion 74 of both sides of the ladder portion 72. A lower end portion of the storage ladder 70 in a state in which the storage ladder 70 is lowered toward the floor portion 28 (see FIG. 2B) is provided with a concave curved surface 70*a* that is smoothly curved so as to be continuous from lower ends of the ladder portion 72, the inclined surface portion 74, and the groove portion 76 toward the floor portion 28.

In the second form, in a state in which the storage ladder 70 is lowered to the floor portion 28 side, a player can play with figurines or the like using the ladder portion 72 as stairs for going up and down between the second-floor right room 22 and the attic room 50. The player can play with figurines or the like using the inclined surface portion 74 as a slide for getting down from the attic room 50 to the second-floor right room 22. The player can place front wheels 84 and rear wheels 86 of a vehicle model 80 (to be described later) on which figurines or the like are placed on the inclined surface portion 74 and the groove portion 76, and can play with figurines or the like using the inclined surface portion 74 and the groove portion 76 as a guide rail or the like for allowing the vehicle model 80 to slide from the attic room 50 to the second-floor right room 22.

As shown in FIG. 10, on both sides of an end portion of the storage ladder 70 opposite to the side on which the curved surface 70*a* is provided in the longitudinal direction, ladder-side shafts (rotation shafts) 70*b* axially protruding outward are respectively provided. A protruding portion 70*c* protruding toward a lower side (a front side in FIG. 10) is provided in a part of a portion of a back surface of the ladder portion 72 close to the ladder-side shaft 70*b*.

On the other hand, attachment portions 24*e* for rotatably attaching the storage ladder 70 and a storage portion (engagement mechanism) 24*f* for storing one end of the storage ladder 70 are provided on the lower surface 24*b* side of the ceiling portion 24. The pair of attachment portions 24*e* are each provided in a plate shape having a laterally elongated opening, and the ladder-side shafts 70*b* of the storage ladder 70 are rotatably inserted into the openings. The storage portion 24*f* is provided in a laterally elongated arch shape of a U shape with respect to the lower surface 24*b*. One end of the storage ladder 70 provided with the curved surface 70*a* is stored inside the storage portion 24*f* provided in an arch shape, whereby the storage ladder 70 is engaged with the storage portion 24*f* and disposed on the back side of the ceiling portion 24.

When the storage ladder 70 is slid along the opening of the attachment portion 24*e* in a state in which one end of the storage ladder 70 is stored in the storage portion 24*f*, the one end of the storage ladder 70 is removed from the storage portion 24*f* When the one end of the storage ladder 70 is removed from the storage portion 24*f*, both of the ladder-side shafts 70*b* are rotated about their axes by the weight of the storage ladder 70, the one end is lowered toward the floor portion 28 side, and the one end of the storage ladder 70 is in contact with the floor portion 28. At this time, the protruding portion 70*c* is in contact with the lower surface 24*b* of the ceiling portion 24, thereby restricting the ladder-side shafts 70*b* from further rotating. In this way, the storage ladder 70 can be lowered to the floor portion 28 side.

Figure 11:
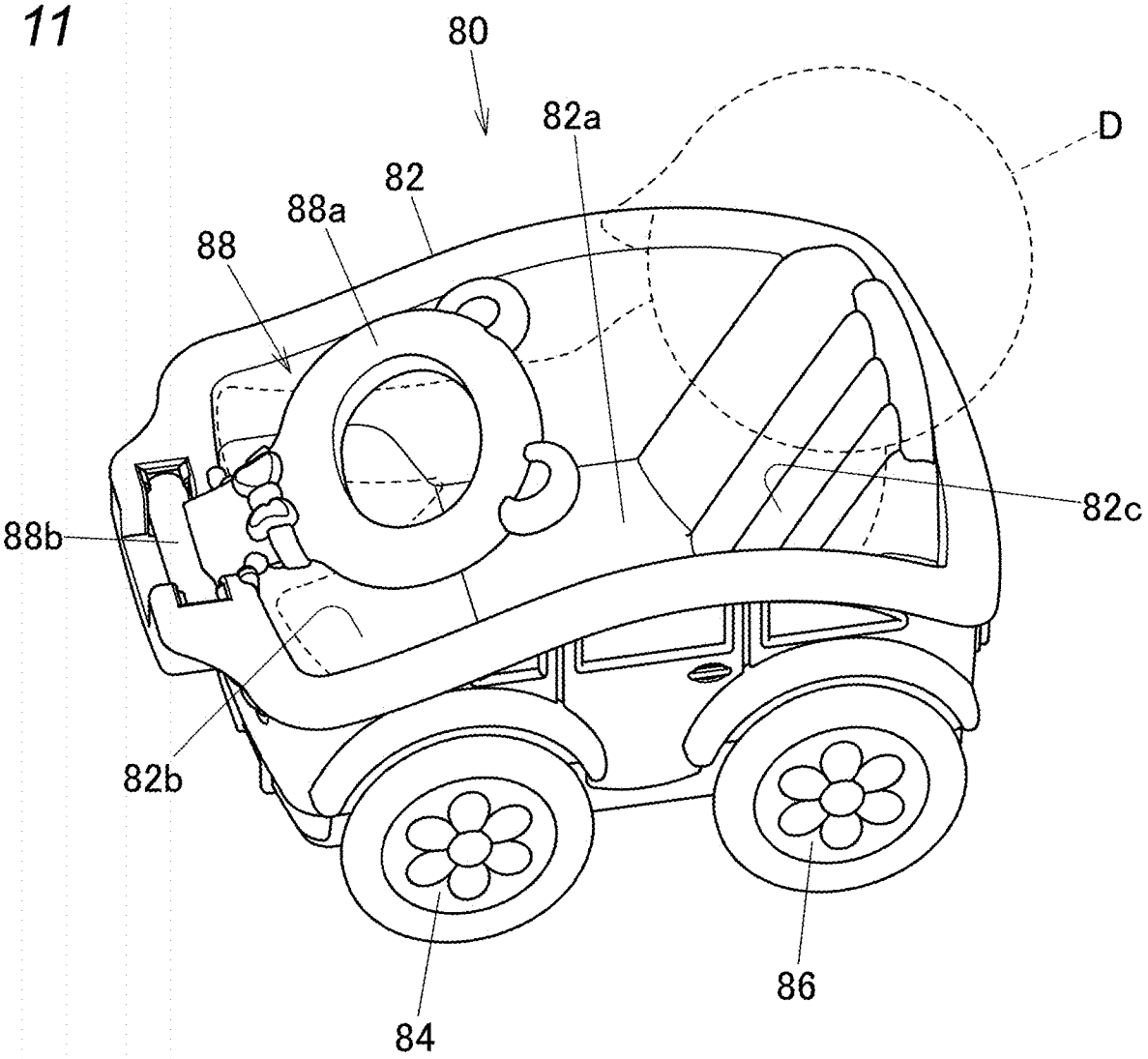
FIG. 11 is a perspective view of a vehicle.

Next, with reference to FIGS. 11 and 12, a vehicle model (vehicle figure body) 80, which is a traveling toy for independent figure playing in which the traveling toy can be played by being slid on the lowered storage ladder 70, will be described. As shown in FIG. 11, the vehicle model 80 is a toy imitating a shape of a four-wheeled vehicle and includes a vehicle body (figurine holding portion) 82, front wheels (wheel) 84 provided on a front side (first direction), and rear wheels (wheel) 86 provided on a rear side (second direction). The front wheels 84 and the rear wheels 86 are independently rotatable and can be placed on the storage ladder 70. The front wheel 84 and the rear wheel 86 have wheel widths such that the front wheel 84 and the rear wheel 86 can placed on the inclined surface portion 74 and the groove portion 76.

The vehicle body 82 has a substantially box shape whose upper side is open, and a seat surface 82*a* that is a flat surface on which a figurine is disposed is provided inside the vehicle body 82. On the inside of the vehicle body 82, a raised portion 82*b* (an example of first wall portion) raised upward are erected on a front side of the seat surface 82*a*, and a backrest 82*c* (an example of a second wall portion) inclined and recessed rearward (opposite side to the seat surface 82*a*) is erected on a rear side of the seat surface 82*a*. A rear side of the raised portion 82*b* is an inclined surface that is inclined toward the seat surface 82*a* side. An arm portion 88 having a substantially annular shape imitating a handle is provided at a front end portion (front side of the seat surface 82*a*) of the vehicle body 82.

The arm portion 88 includes an arm portion annular portion 88*a* having a substantially annular shape. At a front end portion of the arm portion 88, an arm portion pivot shaft 88*b* is provided so as to be supported by the front end portion of the vehicle body 82 in a pivotable manner with a left-right direction as an axial direction, so that the arm portion 88 is tiltable toward the seat surface 82*a*. The arm portion 88 is in contact with the front end portion of the vehicle body 82 in a sliding manner and is configured to be pivoted with a side surface of the arm portion pivot shaft 88*b* being pressed against the front end portion of the vehicle body 82. Therefore, the arm portion 88 is pivoted toward the seat surface 82*a* while receiving a predetermined resistance force from the vehicle body 82.

As shown in FIG. 11, in the vehicle model 80, a figurine D which is an anthropomorphic animal can be held by the vehicle body 82 in a state in which the figurine D is placed on the seat surface 82*a*. For example, in the example shown in FIG. 11, the figurine D is placed on the seat surface 82*a*, leg portions of the figurine D are placed on the raised portion 82*b* and tips of the leg portions are brought close to the front end portion of the vehicle body 82, and the back of the figurine D is brought into contact with the backrest 82*c* in a state in which the figurine D is tilted backward. Then, the arm portion 88 is pivoted and brought into contact with a region from a chest to an abdomen of the figurine D. At this time, the arm portion 88 receives a predetermined resistance force when being pivoted, so that the chest and the abdomen of the figurine D can be suitably pressed by the arm portion annular portion 88*a* of the arm portion 88. In this way, the figurine D is held by the vehicle model 80 so as not to fall off easily.

Figure 12:
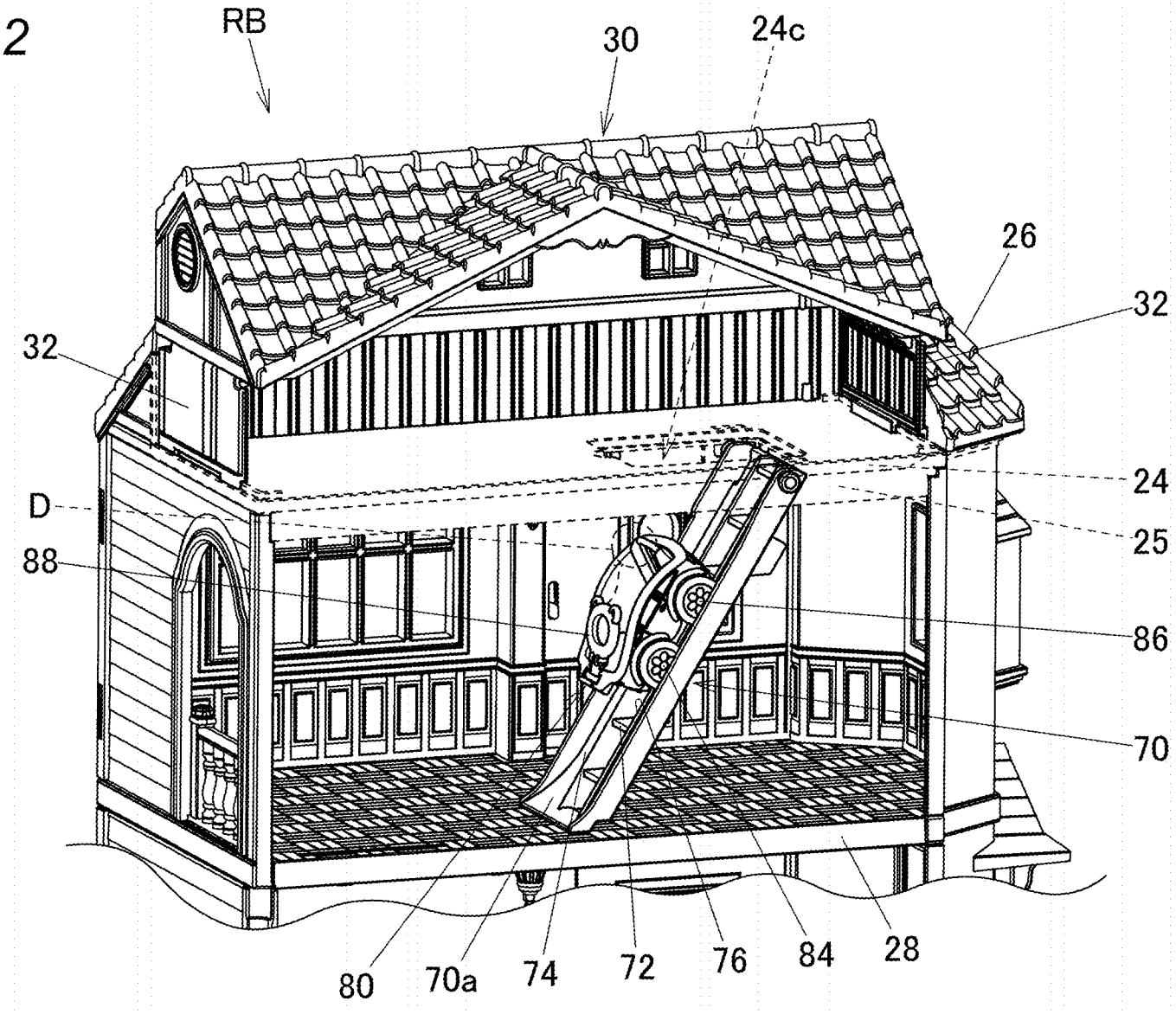
FIG. 12 is a perspective view showing that the vehicle slides on a storage ladder that is lowered.

As shown in FIG. 12, the vehicle model 80 can slide on the lowered storage ladder 70 while holding the figurine D. Here, in the vehicle model 80, an interval between the pair of front wheels 84 and an interval between the pair of rear wheels 86 are substantially equal to an interval between the inclined surface portion 74 and the groove portion 76 in the storage ladder 70. Therefore, in a posture in which a front side of the vehicle model 80 faces the floor portion 28 side, the right front wheel 84 and the right rear wheel 86 are placed on the inclined surface portion 74 of the lowered storage ladder 70, the left front wheel 84 and the left rear wheel 86 are placed on the groove portion 76, and the vehicle model 80 can be smoothly slid from the ceiling portion 24 side toward the floor portion 28 side. Since an inclination angle of the vehicle model 80 sliding on the storage ladder 70 is reduced by the curved surface 70*a* before reaching the floor portion 28, the vehicle model 80 does not roll over forward due to a sliding force, and the front wheels 84 and the rear wheels 86 land on the floor portion 28.

As described above, in the building toy 1 of the present embodiment, by fixing the roof unit 30 on the ceiling portion 24 in a state in which the leg portions 32 of the roof unit 30 are rotated and put inside the roof portion 36, the building toy 1 can have a first form in which the right-side portion RB of the building toy 1 has two floors. Then, by rotating the leg portions 32 to extend to downwardly protrude from the first form and fixing the roof unit 30 on the ceiling portion 24, the attic room 50 in which the height dimension H2 is smaller than the height dimension H1 of the second-floor right room 22 is provided below the roof portion 36, and the building toy 1 can have a three-story second form. By fixing the roof unit 30 on the ceiling portion 24 by inserting the leg portions 32 inside from the second form, the building toy 1 can be set to the first form again. As described above, the building toy 1 can be transformed from the two-story first form to the second form in which the attic room 50 of a small scale is newly provided on an attic with a simple configuration.

According to the embodiment of the present disclosure as described above, a transformable toy and a building toy in the following aspects can be provided.

A transformable toy according to a first aspect includes: a floor portion and a ceiling portion which define a first room therebetween; and a roof unit, in which the roof unit includes at least one leg portion extendable to downwardly protrude from the roof unit and retractable inside the roof unit, and in which the transformable toy is transformable between a first form and a second form, the first form in which the roof unit is disposed on the ceiling portion in a state in which the at least one leg portion is retracted inside the roof unit, the second form in which the roof unit is disposed on the ceiling portion in a state in which the at least one leg portion extends to protrude downward from the roof unit to define a second room between the ceiling portion and the roof unit, the second room having a height dimension smaller than that of the first room.

According to this configuration, the roof unit is disposed on the ceiling portion in a state in which the leg portion is retracted inside the roof unit, and thus the first form can be achieved. Since the roof unit is disposed on the ceiling portion in a state in which the leg portion extends to downwardly protrude from the roof unit, it is possible to achieve the second form in which the second room as an attic room having a height dimension smaller than that of the first room is provided on the ceiling portion. In this way, with a simple configuration, the first form can be transformed into the second form in which the second room is newly provided on the lower side of the roof unit. Therefore, a player can play with figurines or the like by placing a large number of figure bodies imitating furniture or the like in the second room in addition to the first room.

In a transformable toy according to a second aspect, the ceiling portion has a longitudinal shape, and the at least one leg portion includes a pair of leg portions, the pair of leg portions being provided on the roof unit so as to be respectively disposed on both sides of the ceiling portion in a longitudinal direction, each of the pair of leg portions being rotatably connected to the inside of the roof unit by a rotating portion.

According to this configuration, since the leg portions are disposed on both sides of the ceiling portion in the longitudinal direction, the roof unit can be stably disposed on the ceiling portion. By rotating the leg portions, it is possible to easily take in and out the leg portions from the inside of the roof unit, and it is possible to provide a specific configuration for enabling transformation between the first form and the second form with a simple configuration.

In a transformable toy according to a third aspect, the roof unit includes a holding portion configured to hold the pair of leg portions in a state in which the pair of leg portions are retracted inside the roof unit.

According to this configuration, since the leg portions are held in a state of being retracted inside the roof unit by the holding portion, it is possible to prevent the leg portions from rotating due to its own weight, impact, or the like and extending to downwardly protrude from the roof unit from the first form.

A transformable toy according to a fourth aspect includes an outer roof portion connected to the roof unit outside the first room in the second form, in which the outer roof portion includes a locking portion provided at a portion facing the roof unit, and the roof unit includes a locked portion locked to the locking portion in the second form.

According to this configuration, since the roof unit is positioned in a locking direction with respect to the outer roof portion in the second form by locking the locking portion to the locked portion, it is possible to prevent wobbling of the roof unit in the locking direction.

In a transforming transformable toy according to a fifth aspect, a recessed groove is formed on the roof unit, the recessed groove being configured to allow the locking portion to fit into the recessed groove in the second form, and the locked portion in a state of fitting into the recessed groove contacts the locking portion in a left-right direction.

According to this configuration, the roof unit is positioned in the left-right direction with respect to the outer roof portion in the second form. Consequently, it is possible to prevent the roof unit from wobbling in the left-right direction in a state in which the leg portion extends to downwardly protrude.

In a transformable toy according to a sixth aspect, an opening portion is provided in the ceiling portion, a step-shaped member, one end of which is rotatably connected to a back side of the ceiling portion by a rotation shaft and the other end of which is disposed on the back side of the ceiling portion and engaged by an engagement mechanism, is provided at a position overlapping the opening portion on the back side of the ceiling portion, and the one end of the step-shaped member is rotated around the rotation shaft by its own weight and the other end is lowered toward the floor portion by releasing the engagement of the step-shaped member by the engagement mechanism.

According to this configuration, by lowering the step-shaped member toward the floor portion in the second form, a player can play with figurines or the like using the step-shaped member as stairs for going up and down between the first room and the second room.

In a transforming transformable toy according to a seventh aspect, in the second form, the at least one leg portion extends in a direction orthogonal to an upper surface of the ceiling portion.

According to this configuration, the leg portion can define a side wall of the second room.

In a transforming transformable toy according to an eighth aspect, a fitting portion is provided on an upper surface of the ceiling portion, and the fitting portion is configured to: fit a lower surface of the roof unit in the first form; and fit the at least one leg portion in the second form.

According to this configuration, the fitting portion allows the roof unit to be fixed on the ceiling portion in both of the first form and the second form.

A building toy according to a first aspect includes the above transformable toy.

According to this configuration, it is possible to implement a building toy capable of transforming from the first form to the second form in which the second room is newly provided with a simple configuration.

A building toy according to a second aspect includes: a transformable toy; and a vehicle figure body, in which the transformable toy includes: a floor portion and a ceiling portion which define a first room therebetween; and a roof unit, in which the roof unit includes at least one leg portion extendable to downwardly protrude from the roof unit and retractable inside the roof unit, in which the transformable toy is transformable between a first form and a second form, the first form in which the roof unit is disposed on the ceiling portion in a state in which the at least one leg portion is retracted inside the roof unit, the second form in which the roof unit is disposed on the ceiling portion in a state in which the at least one leg portion extends to protrude downward from the roof unit to define a second room between the ceiling portion and the roof unit, the second room having a height dimension smaller than that of the first room, in which an opening portion is provided in the ceiling portion, in which a step-shaped member is provided at a position overlapping the opening portion on a back side of the ceiling portion and has a first end and a second end, the first end being rotatably connected to the back side of the ceiling portion by a rotation shaft, the second end being disposed on the back side of the ceiling portion and configured to be engaged by an engagement mechanism, in which the first end of the step-shaped member is rotated around the rotation shaft by its own weight and the second end is lowered toward the floor portion side by releasing engagement of the step-shaped member by the engagement mechanism, in which the vehicle figure body includes: a wheel that is allowed to be placed on the step-shaped member; and a figurine holding portion configured to hold a figurine, in which the vehicle figure body is configured to slide down on the step-shaped member when the wheel is placed on the stepped member in a state in which the engagement is released, and in which the figurine holding portion includes: a seat surface on which a figurine is disposed; a first wall portion erected on a first side of the seat surface; a second wall portion erected on a second side of the seat surface and recessed in a direction opposite to the seat surface; and an arm portion provided on the first side of the seat surface and tiltable toward the seat surface side.

According to this configuration, a figurine is disposed on the seat surface of the figurine holding portion, the first direction side of the figurine is brought into contact with the first wall portion, the second direction side of the figurine is brought into contact with the second wall portion, and the arm portion is tilted toward the seat surface side, whereby the figurine can be suitably held by the vehicle figure body. Then, by sliding the vehicle figure body holding the figurine on the step-shaped member in a state in which the engagement is released, it is possible to enjoy playing with figurines using the vehicle figure body in the building toy transformed into the second form.

Although the embodiment of the present disclosure has been described above, the present disclosure is not limited to the above embodiment, and various modifications can be made without departing from the scope of the appended claims. For example, in the embodiment, although a configuration in which a cover member for closing an attic opening portion is implemented with one member has been exemplified, the cover member may be implemented with two members. In this case, one member may be a member imitating a table, and the other member may be a member imitating a board that stands against a rear wall portion.

In the embodiment, although a configuration in which a storage ladder is removed from a storage portion and lowered toward a floor portion by sliding the storage ladder is exemplified, for example, a configuration may be adopted in which a protruding portion protruding toward a ceiling portion side is provided in a part of the storage ladder, the protruding portion is engaged in an opening provided in the ceiling portion, and the engagement of the protruding portion is released and the storage ladder is lowered toward the floor portion side by pressing a part of the protruding portion protruding upward from the opening. In this case, the storage ladder may be a leaf spring whose entire body has elasticity. A rib for positioning the storage ladder when storing the storage ladder may be provided on a lower surface side of the ceiling portion.

What is claimed is:

1. A transformable toy comprising:

a floor portion and a ceiling portion which define a first room therebetween; and a roof unit, wherein the roof unit comprises a side wall portion and at least one leg portion extendable to downwardly protrude from the roof unit and retractable inside the roof unit, and wherein the transformable toy is transformable between a first form and a second form, the first form in which the roof unit is disposed on the ceiling portion in a state in which the at least one leg portion is retracted inside the roof unit, the second form in which the roof unit is disposed on the ceiling portion in a state in which the at least one leg portion extends to protrude downward from the roof unit and the side wall portion of the roof unit extends upwards and is exposed on a back side of the roof unit, the extended at least one leg portion and the extended side wall portion defining a second room between the ceiling portion and the roof unit, the second room having a height dimension smaller than that of the first room, and wherein the side wall portion includes a left wall portion, a right wall portion, and a rear wall portion, both the left wall portion and the right wall portion having plate surfaces oriented in a left-right direction, and face each other, the rear wall portion having plate surfaces oriented in the front-rear direction, the rear wall portion connecting the left right wall portion and the right wall portion, and the at least one leg portion is rotatably fitted into a rear receiving portion of the side wall portion.

2. The transformable toy according to claim 1, wherein the ceiling portion has a longitudinal shape, and wherein the at least one leg portion comprises a pair of leg portions, the pair of leg portions being provided on the roof unit so as to be respectively disposed on both sides of the ceiling portion in a longitudinal direction, each of the pair of leg portions being rotatably connected to the inside of the roof unit by a rotating portion.

3. The transformable toy according to claim 2, wherein the roof unit comprises a holding portion configured to hold the pair of leg portions in a state in which the pair of leg portions are retracted inside the roof unit.

4. The transformable toy according to claim 1, further comprising:

an outer roof portion connected to the roof unit outside the first room in the second form, wherein the outer roof portion comprises a locking portion provided at a portion facing the roof unit, and wherein the roof unit comprises a locked portion locked to the locking portion in the second form.

5. The transformable toy according to claim 4, wherein a recessed groove is formed on the roof unit, the recessed groove being configured to allow the locking portion to fit into the recessed groove in the second form, and wherein the locked portion in a state of fitting into the recessed groove contacts the locking portion in a left-right direction.

6. The transformable toy according to claim 1, wherein an opening portion is provided in the ceiling portion, wherein a step-shaped member is provided at a position overlapping the opening portion on a back side of the ceiling portion and has a first end and a second end, the first end being rotatably connected to the back side of the ceiling portion by a rotation shaft, the second end being disposed on the back side of the ceiling portion and configured to be engaged by an engagement mechanism, and wherein, by releasing engagement of the step-shaped member with the engagement mechanism, the first end of the step-shaped member is rotated around the rotation shaft by its own weight and the second end is lowered toward the floor portion.

7. The transformable toy according to claim 1, wherein in the second form, the at least one leg portion extends in a direction orthogonal to an upper surface of the ceiling portion.

8. The transformable toy according to claim 1, wherein a fitting portion is provided on an upper surface of the ceiling portion, and wherein the fitting portion is configured to:

fit a lower surface of the roof unit in the first form; and fit the at least one leg portion in the second form.

9. A building toy comprising:

a transformable toy according to claim 6; and a vehicle figure body, wherein the vehicle figure body comprises:

a wheel that is allowed to be placed on the step-shaped member; and a figurine holding portion configured to hold a figurine, wherein the vehicle figure body is configured to slide down on the step-shaped member when the wheel is placed on the stepped member in a state in which the engagement is released, and wherein the figurine holding portion comprises:

a seat surface on which a figurine is disposed;

a first wall portion erected on a first side of the seat surface;

a second wall portion erected on a second side of the seat surface and recessed in a direction opposite to the seat surface; and an arm portion provided on the first side of the seat surface and tiltable toward the seat surface side.

* * * * *